US007331193B2

(12) United States Patent
Shim

(10) Patent No.: US 7,331,193 B2
(45) Date of Patent: Feb. 19, 2008

(54) REFRIGERATOR

(75) Inventor: In-Bo Shim, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 344 days.

(21) Appl. No.: 11/201,115

(22) Filed: Aug. 11, 2005

(65) Prior Publication Data

US 2006/0032264 A1 Feb. 16, 2006

(30) Foreign Application Priority Data

Aug. 13, 2004 (KR) ..... 10-2004-0063954
Nov. 5, 2004 (KR) ..... 10-2004-0089964
Jul. 21, 2005 (KR) ..... 10-2005-0066500

(51) Int. Cl.
*F25D 17/04* (2006.01)

(52) U.S. Cl. ..... 62/408; 62/186

(58) Field of Classification Search ..... 62/186, 62/265, 408, 441, 526
See application file for complete search history.

(56) References Cited

U.S. PATENT DOCUMENTS 4,006,601 A * 2/1977 Ballarin et al. ..... 62/80
4,165,620 A * 8/1979 Gehauf nee Kiesel et al. ..... 62/256
5,355,686 A * 10/1994 Weiss ..... 62/89
7,093,453 B2 * 8/2006 Asan et al. ..... 62/186
2002/0059805 A1 5/2002 Lee et al.
2003/0037565 A1 2/2003 Kim et al.

FOREIGN PATENT DOCUMENTS

KR 1998-34619 5/1998
KR 2000-18475 4/2000
KR 2000-7584 5/2000
KR 2000-16664 9/2000
KR 2001-9399 2/2001
KR 2004-46869 6/2004

* cited by examiner

*Primary Examiner*—Melvin Jones
(74) *Attorney, Agent, or Firm*—Staas & Halsey LLP

(57) ABSTRACT

A refrigerator including a refrigerating compartment evaporator cover to partition a storage space of a refrigerating compartment and a refrigerating compartment evaporator accommodator, a ventilator which is provided in a lower part of the refrigerating compartment evaporator cover, a damper which is provided in an upper part of the refrigerating compartment evaporator cover to control entrance and exit of cooling air to the ventilator, and a refrigerating compartment evaporator and a freezing compartment evaporator which are connected in serial. The refrigerator allows cooling air to flow smoothly and prevents cooling air continuously generated from a refrigerating compartment evaporator from being rapidly discharged to a refrigerating compartment when a refrigerating compartment stops operating.

20 Claims, 11 Drawing Sheets

REFRIGERATOR

CROSS-REFERENCE TO RELATED APPLICATIONS

This application claims the benefit of Korean Patent Application No. 2004-0063954, filed on Aug. 13, 2004, Korean Patent Application No. 2004-0089964, filed on Nov. 5, 2004, and Korean Patent Application No. 2005-0066500, filed on Jul. 21, 2005, in the Korean Intellectual Property Office, the disclosure of which are incorporated herein by reference.

BACKGROUND OF THE INVENTION

1. Field of the Invention

The present invention relates to a refrigerator, and more particularly, to a refrigerator which prevents a refrigerating compartment thereof from being overcooled due to sudden discharge of unnecessary cooling air from a refrigerating compartment evaporator to the refrigerating compartment.

2. Description of the Related Art

Generally, a conventional refrigerator supplies cooling air provided from a cooling cycle to a storage compartment to cool it down and to keep food stored therein fresh for a long time. Recently, an independent cooling type refrigerator has been developed, in which an evaporator is disposed in the storage compartment including a freezing compartment and a refrigerating compartment, respectively, to keep food at its optimal state.

The independent cooling type refrigerator includes a cooling air supplier on a rear side of the freezing compartment and the refrigerating compartment, respectively. Each cooling air supplier includes an evaporator and a fan. The cooling air supplier inhales cooling air at a high temperature due to circulation to the freezing and refrigerating compartments, respectively into the corresponding evaporator for heat exchange, and forcibly sends the cooling air at a lower temperature due to the heat exchange to the freezing and refrigerating compartments, respectively, again through the fan.

In the conventional independent cooling type refrigerator, the cooling air is continuously generated from the refrigerating compartment evaporator due to refrigerant circulation when the refrigerating compartment stops operating and the freezing compartment operates.

In FIG. 1, the conventional refrigerator includes an inlet 6*a* of a cooling air inhaling path 6 disposed on upper opposite sides of an evaporator 4, thereby preventing the cooling air continuously generated around the evaporator 4 from being introduced to a lower part of the refrigerating compartment and overcooling of the lower part of the refrigerating compartment when the refrigerating compartment reaches a predetermined temperature, and a fan 2 to circulate the cooling air, stops operating. Then, the cooling air which has circulated inside of the storage compartment is inhaled through the inlet 6*a* of the cooling air inhaling path 6 disposed on the upper opposite sides of the evaporator 4. The inhaled cooling air is guided along the cooling air inhaling path 6 to exchange heat with the evaporator 4, and discharged to an upper part of the evaporator 4 through an outlet 6*b* of the cooling air inhaling path 6.

Since the inlet 6*a* and the outlet 6*b* of the cooling air inhaling path 6 are disposed on the upper sides of the evaporator 4, the cooling air flow is formed only on an upper part of the storage compartment corresponding to the upper part of the evaporator 4, and is not smooth on a lower part thereof. That is, as the cooling air does not reach the lower part of the storage compartment, the lower part of the storage compartment includes a higher temperature than that of the upper part thereof.

SUMMARY OF THE INVENTION

Accordingly, it is an aspect of the present invention to provide a refrigerator which allows cooling air to flow smoothly in an entire storage compartment thereof and prevents cooling air continuously generated by a refrigerating compartment evaporator from being rapidly discharged to a refrigerating compartment thereof, while the refrigerating compartment stops operating.

Additional aspects and/or advantages of the present invention will be set forth in part in the description which follows and, in part, will be apparent from the description, or may be learned by practice of the present invention.

The foregoing and/or other aspects of the present invention are achieved by providing a refrigerator having a main body including a freezing compartment and a refrigerating compartment with a storage space respectively, a freezing compartment evaporator and a refrigerating compartment evaporator, a freezing compartment fan and a refrigerating compartment fan to send cooling air generated from the freezing compartment evaporator and the refrigerating compartment evaporator to the freezing compartment and the refrigerating compartment respectively, a refrigerating compartment evaporator accommodator to accommodate the refrigerating compartment evaporator and a discharging duct which is disposed on an upper part of the refrigerating compartment evaporator accommodator and including a discharger, the refrigerator including a refrigerating compartment evaporator cover to partition the storage space of the refrigerating compartment and the refrigerating compartment evaporator accommodator, a ventilator which is provided in a lower part of the refrigerating compartment evaporator cover, a damper which is provided in an upper part of the refrigerating compartment evaporator cover to control entrance and exit of cooling air to the ventilator, and the refrigerating compartment evaporator and the freezing compartment evaporator which are connected in serial.

The refrigerator further includes a controller to control the damper to discharge the cooling air inhaled through the ventilator to the discharging duct through the refrigerating compartment evaporator by opening the damper when the refrigerating compartment fan is turned on, and to allow the cooling air around the refrigerating compartment evaporator to remain in the refrigerating compartment evaporator accommodator by closing the damper when the refrigerating compartment fan is turned off and the freezing compartment fan is turned on.

When the controller controls the damper to be closed, the damper causes the cooling air at a lower temperature than predetermined set temperature of the refrigerating compartment remaining in the refrigerating compartment evaporator accommodator not to be discharged to the refrigerating compartment through the ventilator.

The discharging duct includes a plurality of dischargers, and the damper is provided in a position where the refrigerating compartment evaporator cover and the discharging duct communicate with each other to be disposed in a lower part of a lowest discharger among the plurality of dischargers.

The refrigerator further includes a guide duct which is disposed along an inner case of the refrigerating compartment to make the ventilator and the lower part of the refrigerating compartment communicate each other. The ventilator is of a slit-like shape to correspond to a width of the refrigerating compartment evaporator.

The refrigerating compartment fan is provided between the refrigerating compartment evaporator and the damper.

The foregoing and/or other aspects of the present invention are also achieved by providing a refrigerator having a main body including a freezing compartment and a refrigerating compartment, a machinery compartment having a compressor and a condenser, a freezing compartment evaporator and a refrigerating compartment evaporator which are provided in the freezing compartment and the refrigerating compartment, respectively, a freezing compartment fan and a refrigerating compartment fan to send cooling air generated from the freezing compartment evaporator and the refrigerating compartment evaporator to the freezing compartment and the refrigerating compartment respectively, and a refrigerating compartment duct having a discharging duct including at least one discharger, a refrigerating compartment evaporator cover to cover a refrigerating compartment evaporator accommodator which accommodates the refrigerating compartment evaporator, the refrigerator including a ventilator which is provided in the refrigerating compartment duct to be disposed in a lower part of the refrigerating compartment evaporator, a damper which is provided between the discharging duct and the refrigerating compartment evaporator cover to control entrance and exit of the cooling air to the ventilator, wherein the compressor, the condenser, the refrigerating compartment evaporator and the freezing compartment evaporator are sequentially connected in serial.

The refrigerating compartment evaporator cover and the discharging duct communicate with each other and the damper is provided in a position where the refrigerating compartment evaporator cover and the discharging duct communicate with each other to open and close the position where the refrigerating compartment evaporator cover and the discharging duct communicate with each other.

The refrigerator further includes a controller to control the damper to open the position where the refrigerating compartment evaporator cover and the discharging duct communicate with each other, while operating the refrigerating compartment, and close the position where the refrigerating compartment evaporator cover and the discharging duct communicate with each other, while operating the freezing compartment and not operating the refrigerating compartment.

The refrigerator further includes a guide duct which is provided along an inner case of the refrigerating compartment to make the ventilator and a lower part of the refrigerating compartment communicate with each other.

It is another aspect of the present invention to provide a refrigerator having a main body including a freezing compartment and a refrigerating compartment, a freezing compartment evaporator and a refrigerating compartment evaporator which are connected in serial, and a freezing compartment fan and a refrigerating compartment fan to send cooling air generated from the freezing compartment evaporator and the refrigerating compartment evaporator to the freezing compartment and the refrigerating compartment respectively, the refrigerator including a refrigerating compartment duct having a plurality of dischargers formed in an upper part of the refrigerating compartment evaporator and a ventilator formed in a lower part of the refrigerating compartment evaporator, a damper which is disposed between a lowest discharger among the plurality of dischargers and the refrigerating compartment evaporator to open and close a cooling air path of the refrigerating compartment duct, and a controller to control the damper to open the lowest discharger when the refrigerating compartment fan is turned on, and close the lowest discharger when the refrigerating compartment fan is turned off and the freezing compartment fan is turned on.

The ventilator is of a slit-like shape to correspond to a width of the refrigerating compartment evaporator.

This is another aspect of the present invention to provide a refrigerator having a main body including a freezing compartment and a refrigerating compartment, a freezing compartment evaporator and a refrigerating compartment evaporator which are connected in serial, and a freezing compartment fan and a refrigerating compartment fan to send cooling air generated from the freezing compartment evaporator and the refrigerating compartment evaporator to the freezing compartment and the refrigerating compartment respectively, the refrigerator including a refrigerating compartment duct to accommodate the refrigerating compartment evaporator and having a discharger formed in an upper part of the refrigerating compartment evaporator and a ventilator formed in a lower part of the refrigerating compartment evaporator, a damper which is provided between the discharger and the refrigerating compartment evaporator to open and close a cooling air path of the refrigerating compartment duct, and a controller to control the damper to open the refrigerating compartment duct when the refrigerating compartment fan is turned on, and close the refrigerating compartment duct when the refrigerating compartment fan is turned off and the freezing compartment fan is turned on.

It is another aspect of the present invention to provide a refrigerator having a main body including a freezing compartment and a refrigerating compartment, the refrigerator including a freezing compartment evaporator and a refrigerating compartment evaporator which are connected in serial, a freezing compartment fan and a refrigerating compartment fan to send cooling air generated from the freezing compartment evaporator and the refrigerating compartment evaporator to the freezing compartment and the refrigerating compartment respectively, a refrigerating compartment duct having a plurality of dischargers formed in an upper part of the refrigerating compartment evaporator and a ventilator formed in a lower part of the refrigerating compartment evaporator, and an opening and closing member which is adjacent to the ventilator to open and close the ventilator and control entrance and exit of cooling air to the ventilator.

The refrigerator further includes a controller to control the opening and closing member to open the ventilator when the refrigerating compartment fan is turned on and to allow the cooling air inhaled to the refrigerating compartment evaporator through the ventilator, and to close the ventilator when the refrigerating compartment fan is turned off and the freezing compartment fan is turned on and to allow the cooling air around the refrigerating compartment evaporator to remain in the refrigerating compartment evaporator accommodator, without discharging the cooling air to the refrigerating compartment through the ventilator.

The refrigerator further includes a guide duct which is disposed along an inner case of the refrigerating compartment to make the ventilator and the lower part of the refrigerating compartment communicate with each other.

The opening and closing member includes a motorized damper.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
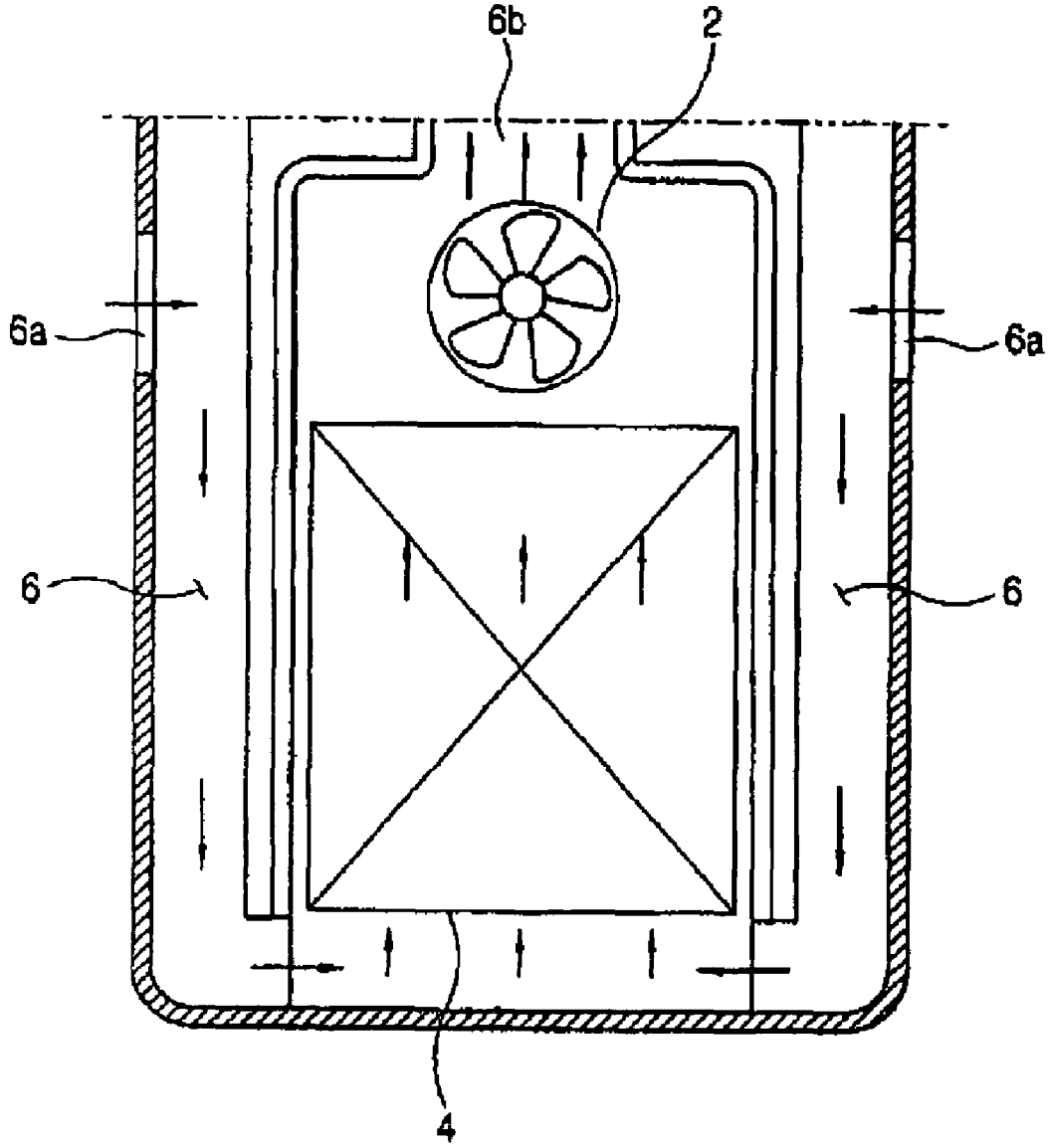
FIG. 1 (PRIOR ART)
FIG. 1 schematically illustrates cooling air flow which is inhaled to an evaporator of a conventional refrigerator.
Figure 2:
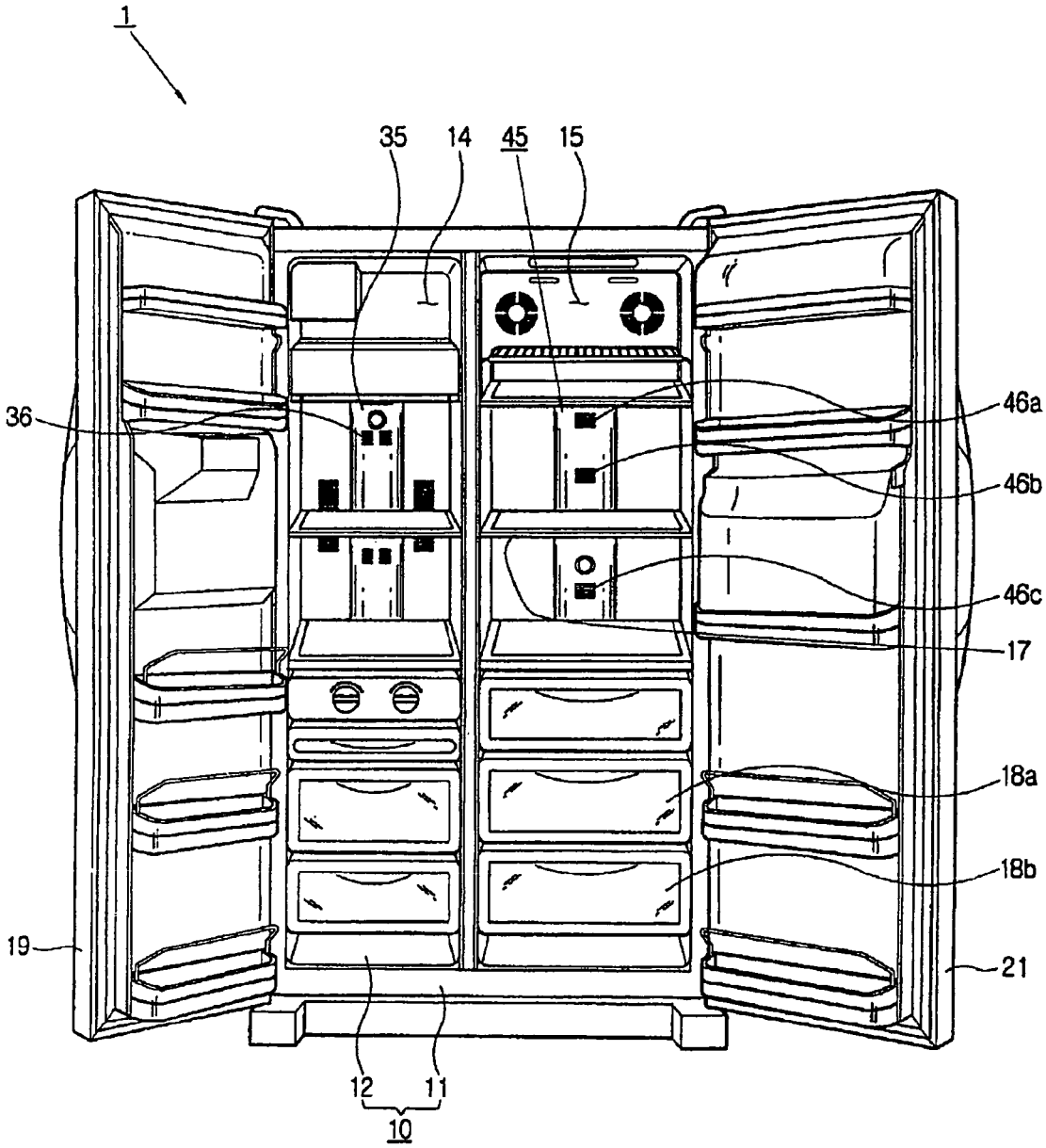
FIG. 2 is a front perspective view of a configuration of a refrigerator according to a first embodiment of the present invention.
Figure 3:
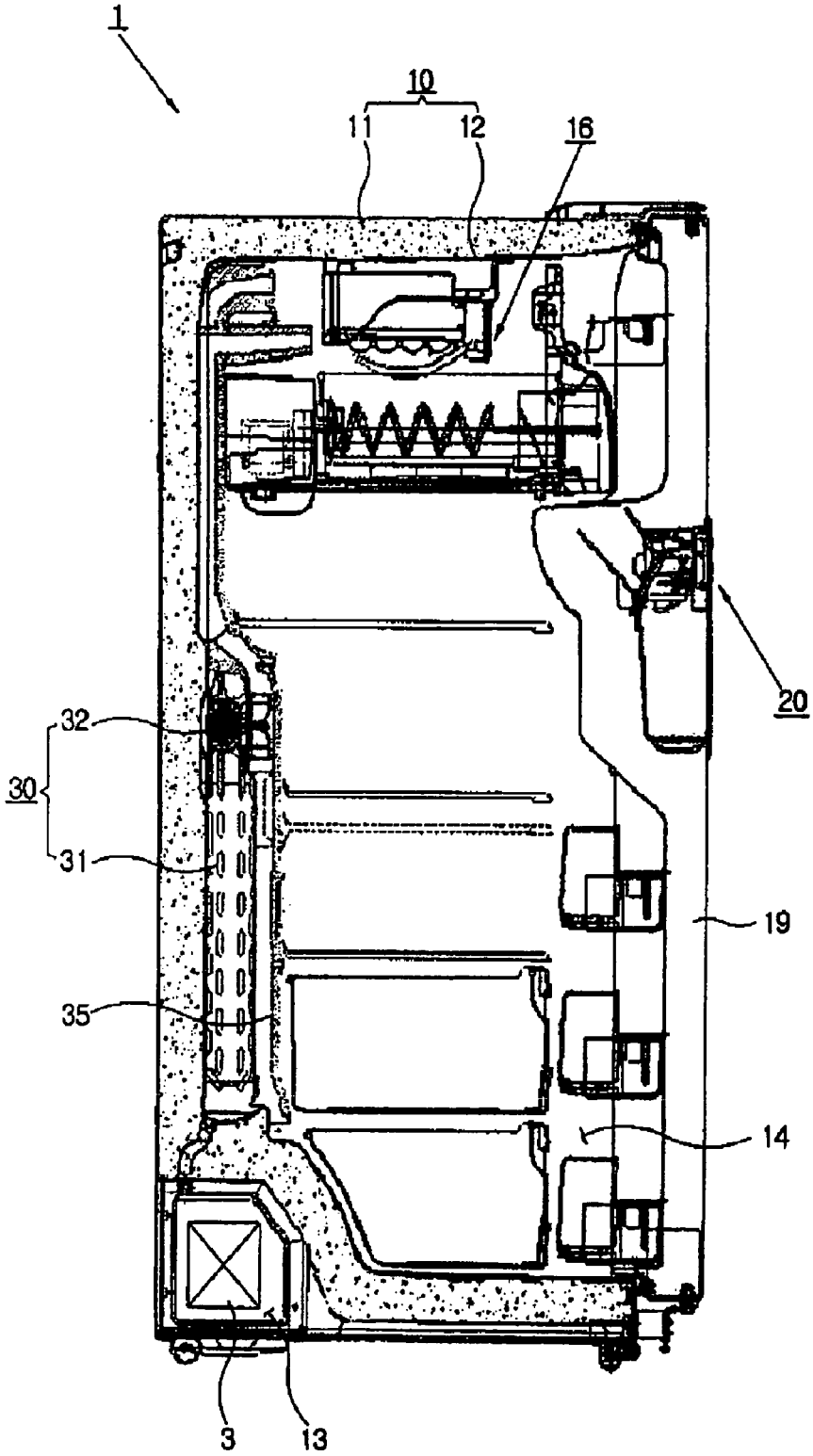
FIG. 3 illustrates a freezing compartment of the refrigerator according to the first embodiment of the present invention.

Reference will now be made in detail to the embodiments of the present invention, examples of which are illustrated in the accompanying drawings, wherein like reference numerals refer to like elements throughout. Hereinbelow, a side by side type refrigerator will be described as an example of the present invention In FIGS. 2 through 9, a refrigerator 1 according to a first embodiment the present invention comprises a main body 10 having a freezing compartment 14 and a refrigerating compartment 15, a freezing compartment door 19 and a refrigerating compartment door 21 which are coupled to the main body 10 to rotatably open and close the freezing compartment 14 and the refrigerating compartment 15, and a freezing compartment cooling air supplier 30 having a freezing compartment evaporator 31 which is disposed in the main body 10 to cool down the freezing compartment 14 and a freezing compartment fan 32 which is adjacent to the freezing compartment evaporator 31 to send the cooling air to the freezing compartment 14.

The refrigerator further comprises a refrigerating compartment cooling air supplier 40 having a refrigerating compartment evaporator 41 which is connected with the freezing compartment evaporator 31 in serial to cool down the refrigerating compartment 15 and a refrigerating compartment fan 42 which is adjacent to the refrigerating compartment evaporator 41 to send the cooling air to the refrigerating compartment 15, a ventilator 49 to accommodate the refrigerating compartment evaporator 41 and formed on a lower part of the refrigerating compartment evaporator 41, to allow air inside the refrigerating compartment 15 to be inhaled to the refrigerating compartment evaporator 41, a refrigerating compartment duct 47 having dischargers 46*a*, 46*b* and 46*c* which are formed on an upper part of the refrigerating compartment evaporator 41 to allow the cooling air of the refrigerating compartment evaporator 41 to be discharged to the refrigerating compartment 15, a damper 50 which is provided between a lowest discharger 46*c* and the refrigerating compartment evaporator 41, in the refrigerating compartment duct 47 to open and close a cooling air path of the refrigerating compartment duct 47, and a controller 60 to control the damper 50 to open the refrigerating compartment 47 when the refrigerating compartment fan is turned on, and close the refrigerating compartment duct 47 when the refrigerating compartment fan 42 is turned off and the freezing compartment fan 31 is turned on.

Figure 9:
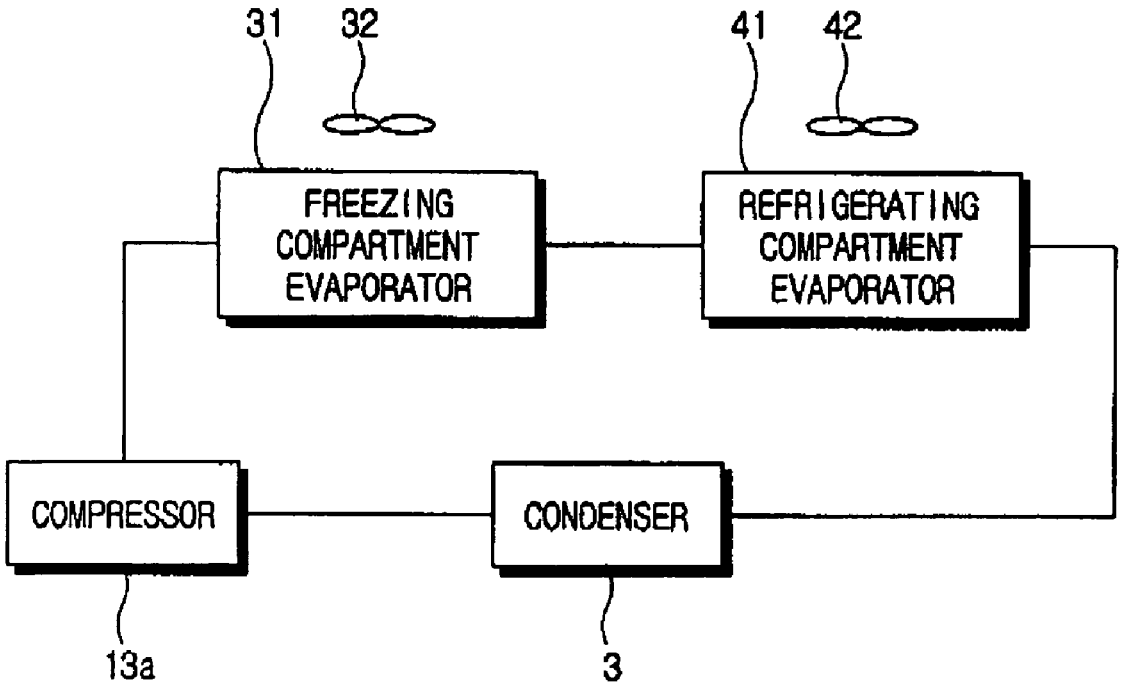
FIG. 9 illustrates a circuit of the cooling operation according to the first embodiment of the present invention.

A cooling cycle is provided in the refrigerator to generate the cooling air. In FIG. 9, the cooling cycle forms a closed circuit in which a compressor 13*a*, a condenser 3, the refrigerating compartment evaporator 41 and the freezing compartment evaporator 31 are sequentially connected in serial.

The main body 10 comprises an outer case 11 to form an external appearance, and an inner case 12 which is partitioned with the freezing compartment 14 and the refrigerating compartment 15 to store a container and food, leaving a space for injecting form in an inner part of the outer case 11. A machinery compartment 13 is provided on a rear lower part of the main body 10. The machinery compartment 13 comprises the compressor 13*a* to compress a gaseous refrigerant at a high temperature and low pressure into high temperature and high pressure and the condenser 3 to condense the refrigerant supplied from the compressor 13*a* into a liquid refrigerant. The refrigerant which is condensed in the condenser 3 is supplied to the refrigerating compartment evaporator 41 and the freezing compartment evaporator 31 sequentially. The respective evaporators 31 and 41 absorb latent heat to cool down surrounding air.

The freezing compartment 14 is formed with a storage space. An ice maker 16 is disposed in the freezing compartment 14. Ice cubes which are generated by the ice maker 16 may be extracted from a dispenser 20 which is provided on a front surface of the freezing compartment door 19. Thus, a user may receive ice cubes from the outside, without opening the freezing compartment door 19.

The freezing compartment cooling air supplier 30 is provided in a rear part of the freezing compartment 14 having the storage space to supply the cooling air generated by the freezing compartment evaporator 31, to the freezing compartment 14 by using the freezing compartment fan 32.

Freezing compartment ducts 35 which are formed with a discharging opening 36 to discharge the cooling air and an inhaling opening (not shown) to inhale the cooling air, are disposed on a front of the freezing compartment cooling air supplier 30.

The refrigerating compartment cooling air supplier 40 (shown in FIG. 4) is provided on a rear part of the refrigerating compartment 15 to supply the cooling air generated by the refrigerating compartment evaporator 41, to the refrigerating compartment 15 by using the refrigerating compartment fan 42.

The refrigerating compartment duct 47 which is formed with the dischargers 46*a*, 46*b* and 46*c* to discharge the cooling air and the ventilator 49 to inhale the cooling air, is disposed on a front of the refrigerating compartment cooling air supplier 40.

The refrigerating compartment duct 47 is disposed on the rear part of the refrigerating compartment 15 in a lengthwise direction. The refrigerating compartment duct 47 comprises a refrigerating compartment evaporator cover 43 which is disposed on a front of a refrigerating compartment evaporator accommodator 44 to partition the storage space of the refrigerating compartment 15 and the refrigerating compartment evaporator accommodator 44 accommodating the refrigerating compartment evaporator 41, and a discharging duct 45 which is disposed on an upper part of the refrigerating compartment evaporator cover 43.

The discharging duct 45 is disposed on the upper part of the refrigerating compartment evaporator cover 43 to discharge the cooling air to the storage space of the refrigerating compartment 15. The plurality of dischargers 46*a*, 46*b* and 46*c* are formed in the discharging duct 45 in a vertical direction.

The ventilator 49 is disposed on the lower part of the refrigerating compartment evaporator 41 to face vegetable boxes 18*a* and 18*b*. The ventilator 49 is of a slit-like shape to correspond to a width of the refrigerating compartment evaporator 41 (shown in FIG. 4). Thus, air in the refrigerating compartment 15 may be smoothly inhaled to the refrigerating compartment evaporator 41 through the ventilator 49 while operating the refrigerating compartment 15.

That is, the cooling air which is generated by the refrigerating compartment evaporator 41 and discharged to the dischargers 46*a*, 46*b* and 46*c*, is inhaled to the ventilator 49, after circulating the refrigerating compartment 15, and cooled down again by the refrigerating compartment evaporator 41. As the cooling air flows to a lower part of the refrigerating compartment 15 smoothly, cooling efficiency may be improved.

When the refrigerating compartment fan 42 is turned off and the freezing compartment fan 32 is turned on while driving the compressor 13*a* (i.e., when the refrigerating compartment 15 satisfies predetermined temperature of the refrigerator 1 to stop operating and the freezing compartment 14 operates alone), the refrigerant is introduced to the refrigerating compartment evaporator 41 and the freezing compartment evaporator 31 to drive the freezing compartment 14.

When the damper 50 does not close a cooling air path of the refrigerating compartment duct 47, the cooling air is continuously generated due to heat exchange between the refrigerating compartment evaporator 41 and the refrigerant. Then, the cooling air around the refrigerating compartment evaporator 41 moves to the lower part of the refrigerating compartment evaporator 41 by self-weight, and is discharged to the refrigerating compartment 15 through the ventilator 49, thereby possibly overcooling the refrigerating compartment 15.

The cooling air which is continuously generated should not be rapidly discharged through the ventilator 49 to solve the overcooling of the refrigerator 1. The damper 50 closes a discharging duct inlet 45*a* at which the refrigerating compartment evaporator cover 43 and the discharging duct 45 communicate with each other. Thus, the cooling air which is continuously generated, by spuit principle, moves to the lower part of the refrigerating compartment 15 and is kept in the refrigerating compartment evaporator accommodator 44, thereby preventing the cooling air from being rapidly discharged.

Accordingly, the controller 60 may control the damper 50 not to discharge the cooling air of the refrigerating compartment evaporator 41 to the refrigerating compartment 15 through the ventilator 49 and close the discharging duct inlet 45*a* of the refrigerating compartment duct 47.

The refrigerator 1 may further comprise a guide duct 70 which is disposed along the inner case 12 of the refrigerating compartment 15 to make the ventilator 49 and the lower part of the refrigerating compartment 15 communicate each other. A first end 71 of the guide duct 70 is coupled to the refrigerating compartment duct 47 corresponding to the ventilator 49, and a second end 72 thereof is open toward a lower vegetable box 18*b*. Thus, air in the refrigerating compartment 15 is introduced to the ventilator 49 through the second end 72 of the guide duct 70 and cooled down by the refrigerating compartment evaporator 41.

The refrigerating compartment 15 is provided with a plurality of shelves 17 to keep food thereon, wherein an upper vegetable box 18*a* and the lower vegetable box 18*b* are disposed on a lower part of the shelves 17 to store fruit and vegetable.

The damper 50 may rotate in the refrigerating compartment duct 47 in a vertical direction, and is disposed on a lower part of the lowest discharger 46*c* as a cover discharger.

Thus, if the controller 60 controls the damper 50 to close the refrigerating compartment duct 47 for a predetermined operation, the damper 50 closes the cooling air path toward the upper dischargers 46*a* and 46*b* comprising the lowest discharger 46*c* of the refrigerating compartment evaporator 41.

Here, the predetermined operation refers to a stop phase of the refrigerating compartment 15. At this phase, the predetermined set temperature of the refrigerating compartment 15 is satisfied, thereby turning off the refrigerating compartment fan 42 and turning on the freezing compartment fan 32.

At the stop phase of the refrigerating compartment 15, the cooling air generated from the refrigerating compartment evaporator 41 is discharged to the refrigerating compartment 15 through the second end 71 of the guide duct 70 communicating with the ventilator 49, instead of being discharged to the dischargers 46*a*, 46*b* and 46*c*. At this time, the controller 60 controls the damper 50 to prevent the cooling air from being discharged to the refrigerating compartment 15 through the ventilator 49 and close the lowest discharger 46*c*.

That is, when the refrigerating compartment fan 42 is turned off and the freezing compartment fan 32 is turned on, the surrounding area and the lower part of the refrigerating compartment evaporator 41 is formed with the cooling air, and the upper part of the refrigerating compartment evaporator 41 is formed with air at a relatively high temperature. When the lowest discharger 46*c* is closed, the air of a high temperature which is around the upper part of the lowest discharger 46*c* does not move to the refrigerating compartment evaporator 41. Then, the air flow is restrained and the cooling air is prevented from being discharged to the refrigerating compartment 15 through the ventilator 49. The cooling air of the refrigerating compartment evaporator 41 is not discharged to the refrigerating compartment 15 through the second end 72 of the guide duct 70, thereby preventing overcooling the refrigerating compartment 15.

Referring to FIGS. 4 through 7, the cooling air flow of the refrigerating compartment 15 according to the present invention is as follows.

Figure 4:
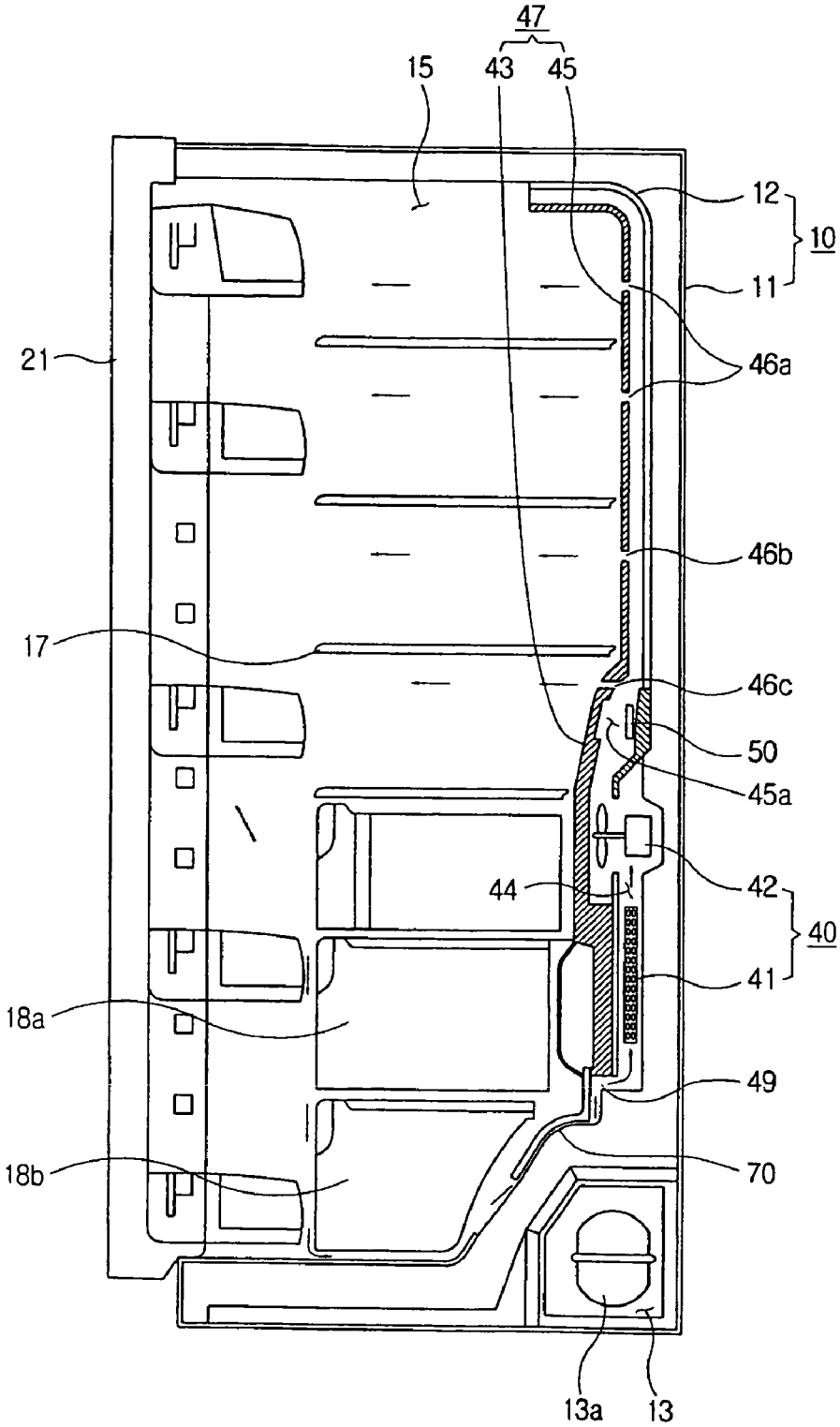
FIG. 4 illustrates cooling air flow of a refrigerating compartment during a cooling operation of the refrigerating compartment in which a refrigerating compartment fan is turned on, of the refrigerator according to the first embodiment of the present invention.
Figure 5:
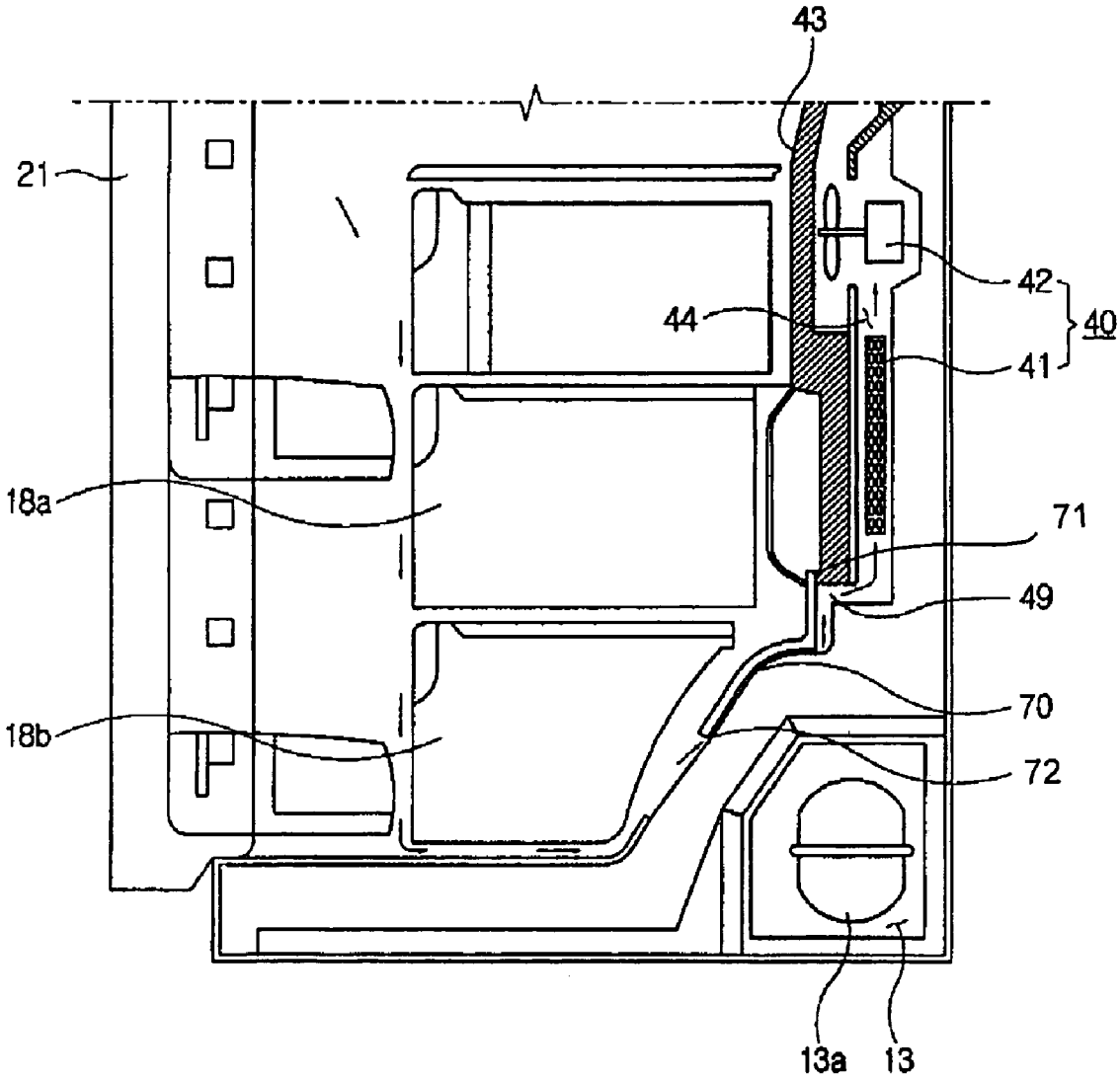
FIG. 5 is an enlarged perspective view of the cooling air flow of a refrigerating compartment evaporator in FIG. 4.

As shown in FIGS. 4 and 5, while operating the refrigerating compartment 15, i.e., when the compressor 13*a* operates and the refrigerating compartment fan 42 is turned on, the air in the refrigerating compartment 15 is inhaled to the refrigerating compartment evaporator 41 through the second end 72 of the guide duct 70 to be cooled down by the refrigerating compartment evaporator 41 and discharged to the refrigerating compartment 15 through the dischargers 46*a*, 46*b* and 46*c*. As the cooling air reaches the middle and lower parts of the refrigerating compartment 15, the cooling efficiency of the refrigerator 1 may be improved.

When the predetermined set temperature of the refrigerating compartment 15 is satisfied, and the refrigerating compartment fan 42 is turned off and the freezing compartment fan 32 is turned on to operate the freezing compartment 14, the refrigerant is introduced to the freezing compartment evaporator 31 through the refrigerating compartment evaporator 41 to operate the freezing compartment 14 as shown in FIG. 9. At this time, the cooling air which is continuously being cooled down in the refrigerating compartment evaporator 41 is not discharged to the dischargers 46*a*, 46*b* and 46*c*, and instead flows along the guide duct 70 of the refrigerating compartment evaporator 41 by self-weight. Then, the controller 60 controls the damper 50 to close the discharging duct inlet 45*a* to prevent the cooling air from being discharged to the refrigerating compartment 15 through the second end 72 of the guide duct 70.

Figure 6:
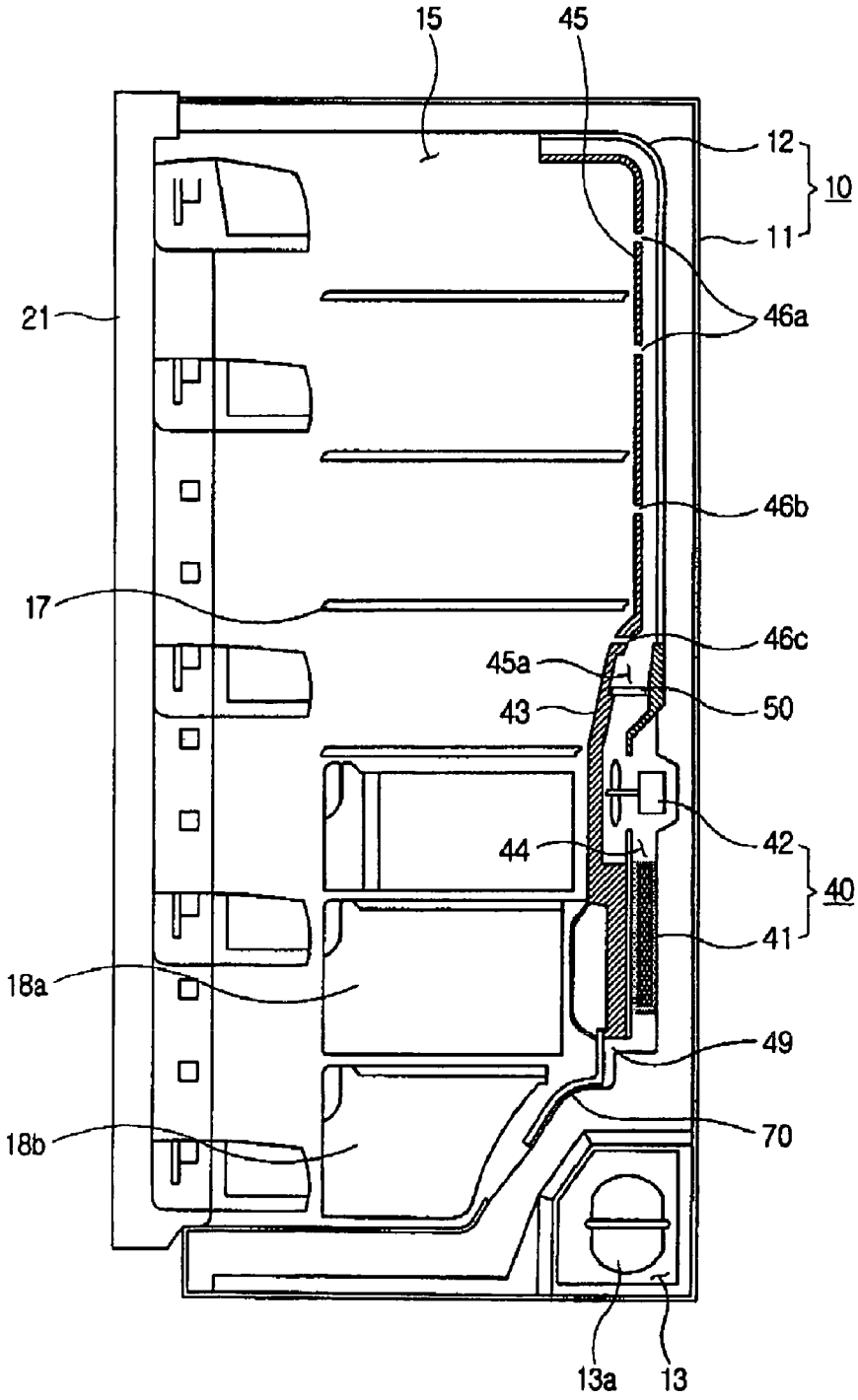
FIG. 6 illustrates cooling air flow of the refrigerating compartment when operating the freezing compartment and not operating the refrigerating compartment during a cooling operation in which a freezing compartment fan is turned on and the refrigerating compartment fan is turned off, of the refrigerator according to the first embodiment of the present invention.
Figure 7:
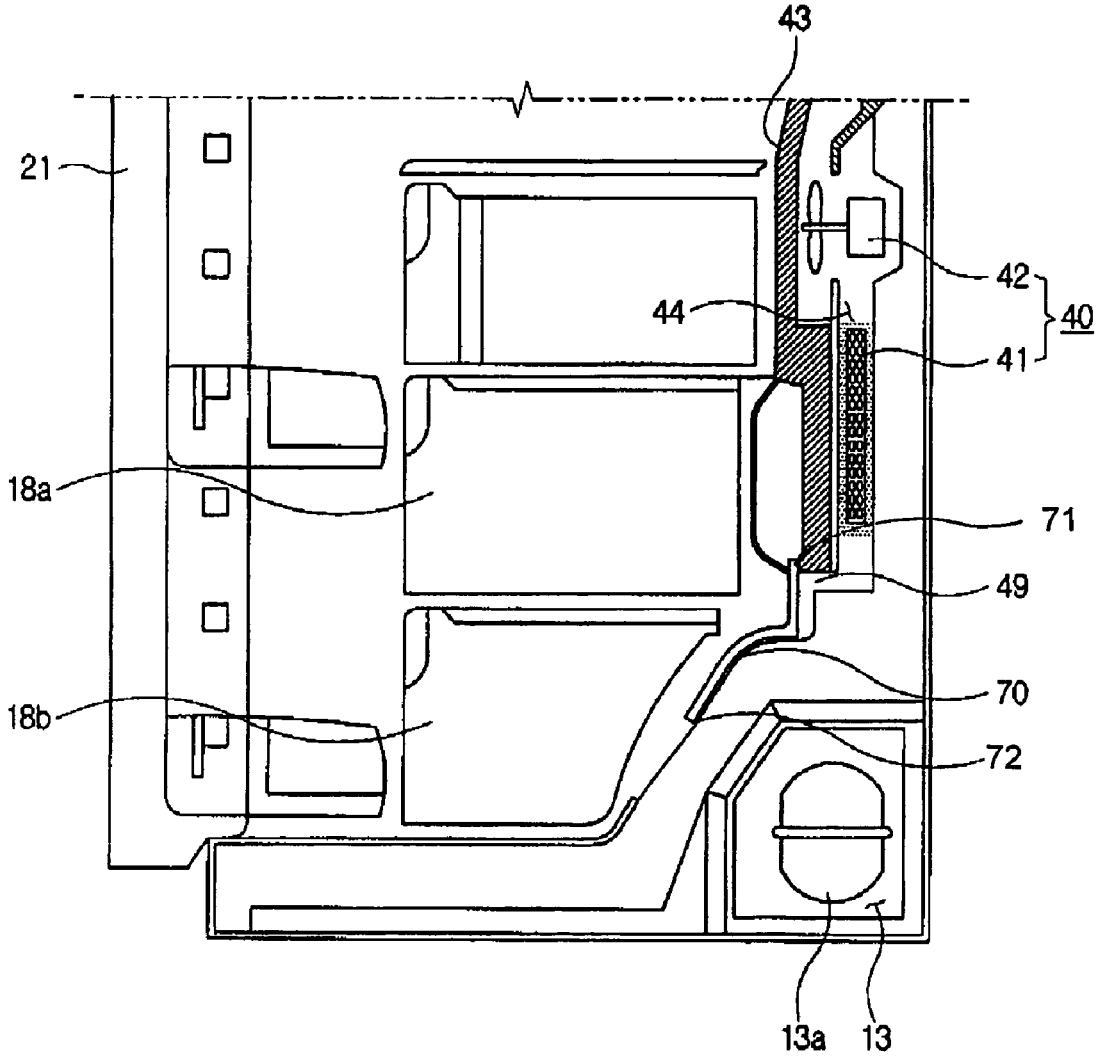
FIG. 7 is an enlarged perspective view of the cooling air flow of the refrigerating compartment evaporator in FIG. 6.
Figure 8:
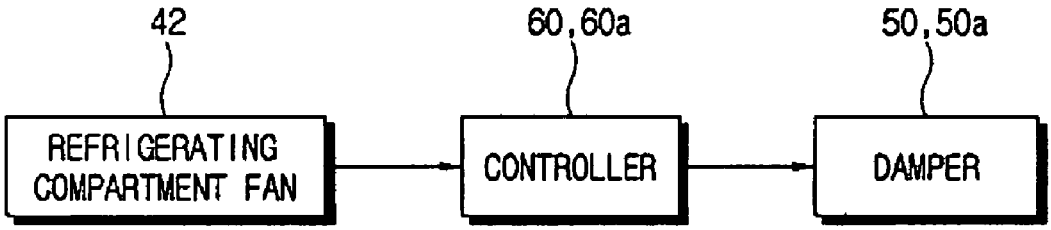
FIG. 8 is a control block diagram of the refrigerator according to the first embodiment of the present invention.

As shown in FIGS. 6 and 7, when the discharging duct inlet 45*a* is closed, the air around the upper part of the discharging duct inlet 45*a* does not move to the refrigerating compartment evaporator 41. The air flow in the refrigerating compartment evaporator accommodator 44 is restrained due to the spuit principle and the cooling air is prevented from being rapidly discharged to the refrigerating compartment 15 through the ventilator 49. Accordingly, the cooling air of the refrigerating compartment evaporator 41 is not discharged to the refrigerating compartment 15 along the second end 72 of the guide duct 70, thereby preventing overcooling the refrigerating compartment 15.

Figure 10A:
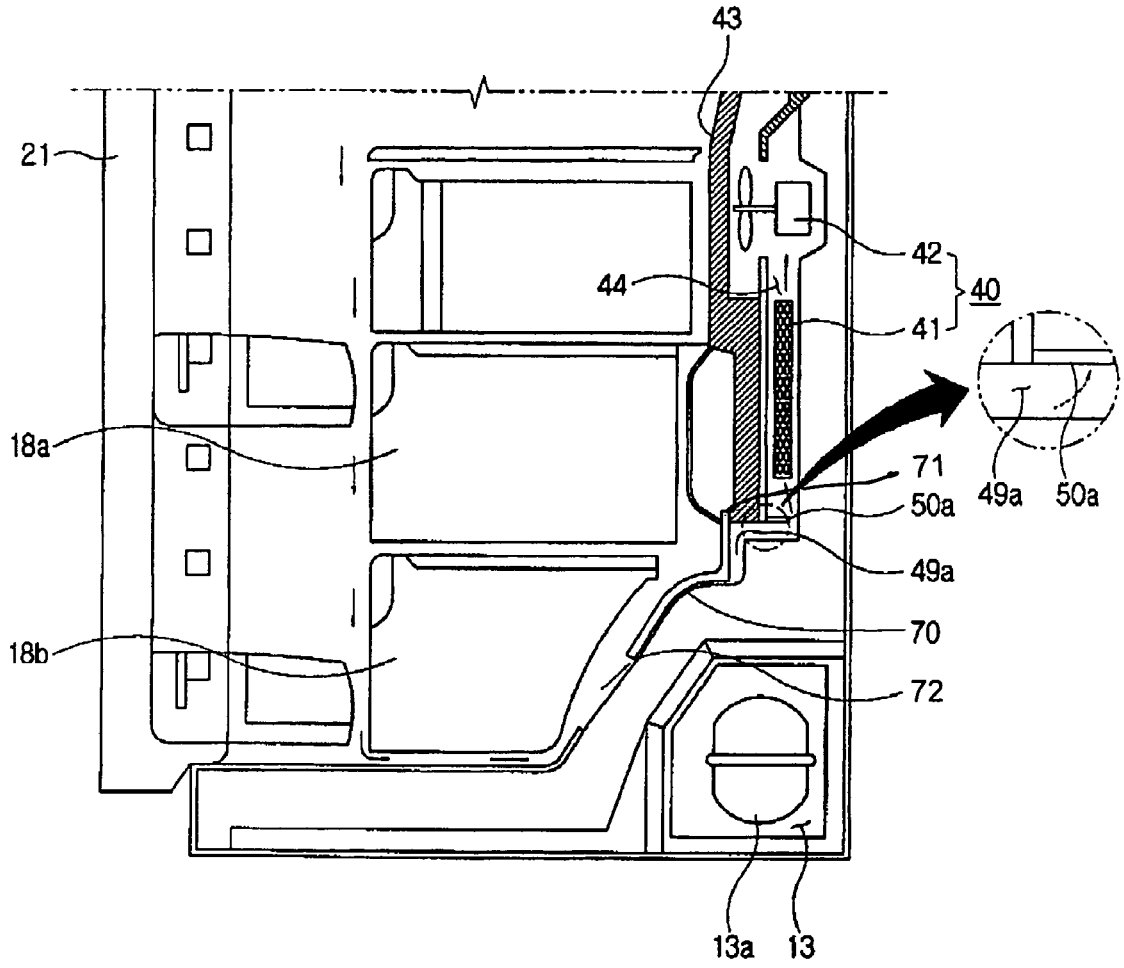
FIG. 10A illustrates cooling air flow of a refrigerating compartment when operating the refrigerating compartment in a cooling operation in which a refrigerating compartment fan is turned on, of the refrigerator according to a second embodiment of the present invention.
Figure 10B:
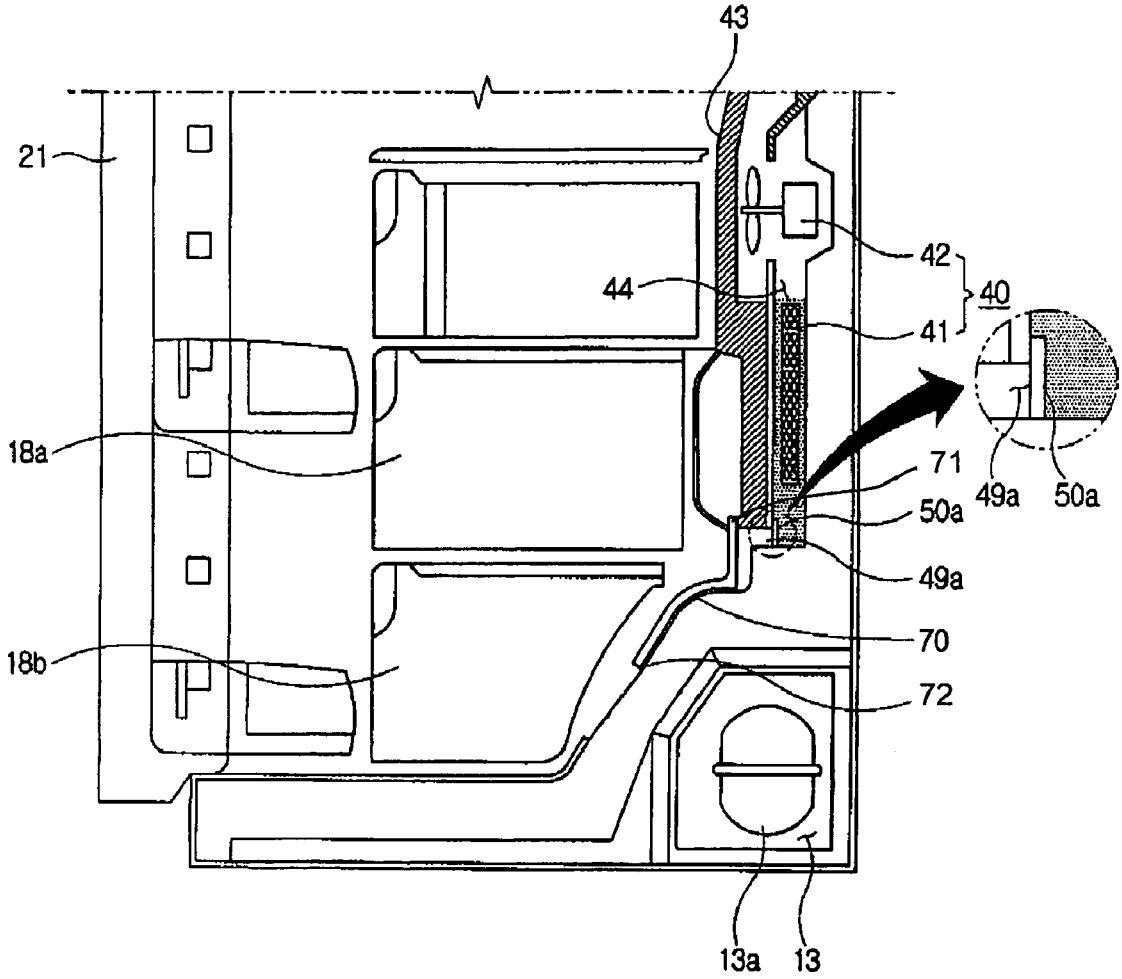
FIG. 10B illustrates cooling air flow of a refrigerating compartment evaporator when operating the freezing compartment and not operating the refrigerating compartment in a cooling operation in which a freezing compartment fan is turned on and the refrigerating compartment fan is turned off, of the refrigerator according to the second embodiment of the present invention.

In the first embodiment, the damper 50 is provided in the refrigerating compartment duct 47 to be disposed in the lower part of the lowest discharger 46*c*. Alternatively, as shown in FIGS. 10*a* and 10*b*, a damper 50*a* may be adjacent to a ventilator 49*a* as a opening and closing member, and the ventilator 49*a* may be open and closed by the damper 50*a*. Here, the damper 50*a* comprise a motorized damper according to a second embodiment of the present invention.

A controller 60*a* controls the damper 50*a* to open and close the ventilator 49*a*. The controller 60*a* controls the damper 50*a* to open the ventilator 49*a* if a refrigerating compartment fan 42 is turned on, and close the ventilator 49*a* if the refrigerating compartment fan 42 is turned off and a freezing compartment fan 32 is turned on.

Referring to FIG. 10A, the process of opening and closing the ventilator 49*a* of the damper 50*a* will be described in detail. While operating a refrigerating compartment 15 (i.e., when a compressor 13*a* operates and the refrigerating compartment fan 42 is turned on), the cooling air discharged to the refrigerating compartment 15 through dischargers 46*a*, 46*b* and 46*c* circulates the refrigerating compartment 15 and is inhaled to a refrigerating compartment evaporator 41 through the ventilator 49*a* to be cooled down again by the refrigerating compartment evaporator 41. Thus, the overall cooling air flow of the refrigerating compartment 15 becomes smooth, thereby improving cooling efficiency.

When the predetermined set temperature of the refrigerating compartment 15 is satisfied, and the refrigerating compartment fan 42 is turned off and the freezing compartment fan 32 is turned on, and a refrigerant is introduced to a freezing compartment evaporator 31 through the refrigerating compartment evaporator 41 to operate a freezing compartment 14. At this time, the cooling air which is continuously being cooled down in the refrigerating compartment evaporator 41 is not discharged to the dischargers 46*a*, 46*b* and 46*c*, and flows along a guide duct 70 of the refrigerating compartment evaporator 41 by self-weight. Then, the controller 60 controls the damper 50*a* to close the ventilator 49*a* to prevent the cooling air from being discharged to the refrigerating compartment 15 through a second end 72 of the guide duct 70.

As shown in FIG. 10B, when the ventilator 49*a* is closed, the cooling air at lower temperature than the predetermined set temperature of the refrigerating compartment 15, around the refrigerating compartment evaporator 41, may be prevented from being discharged to the refrigerating compartment 15 through the ventilator 49*a*. The cooling air of the refrigerating compartment evaporator 41 is not discharged to the refrigerating compartment 15 through the second end 71 of the guide duct 70, thereby preventing overcooling the refrigerating compartment 15.

Frost is less generated in the refrigerator according to the first embodiment of the present invention in which the damper 50 is disposed on the upper part of the refrigerating compartment evaporator 41, than in the refrigerator according to the second embodiment in which the damper 50*a* is disposed on the lower part of the refrigerating compartment evaporator 41.

In the foregoing first and second embodiments, the cooling air of the refrigerating compartment 15 is inhaled to the refrigerating compartment evaporator 41 through the second end 72 of the guide duct 70.

Alternatively, the cooling air may be directly inhaled to the refrigerating compartment evaporator 41 through the ventilators 49 and 49*a* in the case that the guide duct 70 is not provided.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator having a main body including a freezing compartment and a refrigerating compartment with a storage space respectively, a freezing compartment evaporator and a refrigerating compartment evaporator, a freezing compartment fan and a refrigerating compartment fan to send cooling air generated from the freezing compartment evaporator and the refrigerating compartment evaporator to the freezing compartment and the refrigerating compartment respectively, a refrigerating compartment evaporator accommodator to accommodate the refrigerating compartment evaporator and a discharging duct which is disposed on an upper part of the refrigerating compartment evaporator accommodator and having a discharger, the refrigerator comprising:

a refrigerating compartment evaporator cover to partition the storage space of the refrigerating compartment and the refrigerating compartment evaporator accommodator;

a ventilator which is provided in a lower part of the refrigerating compartment evaporator cover;

a damper which is provided in an upper part of the refrigerating compartment evaporator cover to control entrance and exit of cooling air to the ventilator; and wherein the refrigerating compartment evaporator and the freezing compartment evaporator are connected in serial.

2. The refrigerator according to claim 1, further comprising a controller to control the damper to discharge the cooling air inhaled through the ventilator to the discharging duct through the refrigerating compartment evaporator by opening the damper when the refrigerating compartment fan is turned on, and to allow the cooling air around the refrigerating compartment evaporator to remain in the refrigerating compartment evaporator accommodator by closing the damper when the refrigerating compartment fan is turned off and the freezing compartment fan is turned on.

3. The refrigerator according to claim 2, wherein when the controller controls the damper to be closed, the cooling air at a lower temperature than a predetermined set temperature of the refrigerating compartment remains in the refrigerating compartment evaporator accommodator and is not discharged to the refrigerating compartment through the ventilator.

4. The refrigerator according to claim 3, wherein the discharging duct comprises plurality of dischargers, and the damper is provided in a position where the refrigerating compartment evaporator cover and the discharging duct communicate with each other, to be disposed in a lower part of a lowest discharger among the plurality of dischargers.

5. The refrigerator according to claim 4, further comprising a guide duct which is disposed along an inner case of the refrigerating compartment wherein the ventilator and the lower part of the refrigerating compartment communicate each other.

6. The refrigerator according to claim 5, wherein the ventilator is of a slit-like shape to correspond to a width of the refrigerating compartment evaporator.

7. The refrigerator according to claim 6, wherein the refrigerating compartment fan is provided between the refrigerating compartment evaporator and the damper.

8. A refrigerator having a main body including a freezing compartment and a refrigerating compartment, a machinery compartment which is provided with a compressor and a condenser, a freezing compartment evaporator and a refrigerating compartment evaporator which are provided in the freezing compartment and the refrigerating compartment, a freezing compartment fan and a refrigerating compartment fan to send cooling air generated from the freezing compartment evaporator and the refrigerating compartment evaporator to the freezing compartment and the refrigerating compartment respectively, and a refrigerating compartment duct having a discharging duct including at least one discharger and a refrigerating compartment evaporator cover to cover a refrigerating compartment evaporator accommodator which accommodates the refrigerating compartment evaporator, the refrigerator comprising:

a ventilator which is provided in the refrigerating compartment duct to be disposed in a lower part of the refrigerating compartment evaporator;

a damper which is provided between the discharging duct and the refrigerating compartment evaporator cover to control entrance and exit of the cooling air to the ventilator; and wherein the compressor, the condenser, the refrigerating compartment evaporator and the freezing compartment evaporator which are sequentially connected in serial.

9. The refrigerator according to claim 8, wherein the refrigerating compartment evaporator cover and the discharging duct communicate with each other, and the damper is provided in a position where the refrigerating compartment evaporator cover and the discharging duct communicate each other, to open and close the position where the refrigerating compartment evaporator cover and the discharging duct communicate with each other.

10. The refrigerator according to claim 8, further comprising a controller to control the damper to open the position where the refrigerating compartment evaporator cover and the discharging duct communicate with each other, while operating the refrigerating compartment, and close the position where the refrigerating compartment evaporator cover and the discharging duct communicate with each other, while operating the freezing compartment and not operating the refrigerating compartment.

11. The refrigerator according to claim 10, further comprising a guide duct which is provided along an inner case of the refrigerating compartment to allow the ventilator and a lower part of the refrigerating compartment communicate each other.

12. A refrigerator having a main body including a freezing compartment and a refrigerating compartment, a freezing compartment evaporator and a refrigerating compartment evaporator which are connected in serial, and a freezing compartment fan and a refrigerating compartment fan to send cooling air generated from the freezing compartment evaporator and the refrigerating compartment evaporator to the freezing compartment and the refrigerating compartment respectively, the refrigerator comprising:

a refrigerating compartment duct comprising a plurality of dischargers formed in an upper part of the refrigerating compartment evaporator and a ventilator formed in a lower part of the refrigerating compartment evaporator;

a damper which is disposed between a lowest discharger among the plurality of dischargers and the refrigerating compartment evaporator to open and close a cooling air path of the refrigerating compartment duct; and a controller to control the damper to open the lowest discharger when the refrigerating compartment fan is turned on, and close the lowest discharger if the refrigerating compartment fan is turned off and the freezing compartment fan is turned on.

13. The refrigerator according to claim 12, wherein the ventilator is of a slit-like shape to correspond to a width of the refrigerating compartment evaporator.

14. A refrigerator having a main body including a freezing compartment and a refrigerating compartment, a freezing compartment evaporator and a refrigerating compartment evaporator which are connected in serial, and a freezing compartment fan and a refrigerating compartment fan to send cooling air generated from the freezing compartment evaporator and the refrigerating compartment evaporator to the freezing compartment and the refrigerating compartment respectively, the refrigerator comprising:

a refrigerating compartment duct to accommodate the refrigerating compartment evaporator and having a discharger formed in an upper part of the refrigerating compartment evaporator and a ventilator formed in a lower part of the refrigerating compartment evaporator;

a damper which is provided between the discharger and the refrigerating compartment evaporator to open and close a cooling air path of the refrigerating compartment duct; and a controller to control the damper to open the refrigerating compartment duct when the refrigerating compartment fan is turned on, and close the refrigerating compartment duct when the refrigerating compartment fan is turned off and the freezing compartment fan is turned on.

15. A refrigerator having a main body including a freezing compartment and a refrigerating compartment, the refrigerator comprising:

a freezing compartment evaporator and a refrigerating compartment evaporator which are connected in serial;

a freezing compartment fan and a refrigerating compartment fan to send cooling air generated from the freezing compartment evaporator and the refrigerating compartment evaporator to the freezing compartment and the refrigerating compartment respectively;

a refrigerating compartment duct having a plurality of dischargers formed in an upper part of the refrigerating compartment evaporator and a ventilator formed in a lower part of the refrigerating compartment evaporator; and an opening and closing member which is adjacent to the ventilator to open and close the ventilator and control entrance and exit of cooling air to the ventilator.

16. The refrigerator according to claim 15, further comprising a controller to control the opening and closing member to open the ventilator when the refrigerating compartment fan is turned on wherein the cooling air is inhaled to the refrigerating compartment evaporator through the ventilator, and to close the ventilator when the refrigerating compartment fan is turned off and the freezing compartment fan is turned on wherein the cooling air around the refrigerating compartment evaporator remains in the refrigerating compartment evaporator accommodator, without discharging the cooling air to the refrigerating compartment through the ventilator.

17. The refrigerator according to claim 16, further comprising a guide duct which is disposed along an inner case of the refrigerating compartment to make the ventilator and the lower part of the refrigerating compartment communicate with each other.

18. The refrigerator according to claim 17, wherein the opening and closing member comprises a motorized damper.

19. The refrigerator according to claim 15, further comprising a guide duct which is disposed along an inner case of the refrigerating compartment to make the ventilator and the lower part of the refrigerating compartment communicate with each other.

20. The refrigerator according to claim 19, wherein the opening and closing member comprises a motorized damper.

* * * * *

UNITED STATES PATENT AND TRADEMARK OFFICE

CERTIFICATE OF CORRECTION

PATENT NO. : 7,331,193 B2
APPLICATION NO. : 11/201115
DATED : February 19, 2008
INVENTOR(S) : In-bo Shim It is certified that error appears in the above-identified patent and that said Letters Patent is hereby corrected as shown below:

On the Title Page, Item -56- (Foreign Patent Documents), Line 1, after "1998-34619" change "5/1998" to --8/1998--.

Column 11, Line 42, after "communicate" insert --with--.

Column 12, Line 16, before "each" insert --with--.

Column 12, Line 31, after "communicate" insert --with--.

Signed and Sealed this

Twenty-second Day of July, 2008

JON W. DUDAS
*Director of the United States Patent and Trademark Office*